US007300553B2

(12) United States Patent
Poikolainen et al.

(10) Patent No.: US 7,300,553 B2
(45) Date of Patent: Nov. 27, 2007

(54) ARRANGEMENT FOR A WIRE SECTION OF A PAPER OR BOARD MACHINE

(75) Inventors: Antti Poikolainen, Jyväskylä (FI); Aimo Närväinen, Palokka (FI)

(73) Assignee: Metso Paper, Inc., Helsinki (FI)

( * ) Notice: Subject to any disclaimer, the term of this patent is extended or adjusted under 35 U.S.C. 154(b) by 355 days.

(21) Appl. No.: 10/525,595

(22) PCT Filed: Aug. 26, 2003

(86) PCT No.: PCT/FI03/00622

§ 371 (c)(1),
(2), (4) Date: Mar. 24, 2005

(87) PCT Pub. No.: WO2004/020734

PCT Pub. Date: Mar. 11, 2004

(65) Prior Publication Data

US 2005/0241792 A1 Nov. 3, 2005

(30) Foreign Application Priority Data

Aug. 28, 2002 (FI) ..... 20021534

(51) Int. Cl.
*D21F 1/00* (2006.01)
*D21F 11/00* (2006.01)

(52) U.S. Cl. ..... 162/301; 162/203; 162/217; 162/300; 162/303; 162/363; 162/368; 162/370

(58) Field of Classification Search ..... 162/198, 162/199, 203, 272–274, 300, 301, 303, 363–374, 162/217
See application file for complete search history.

(56) References Cited

U.S. PATENT DOCUMENTS

| | | | | |
|---|---|---|---|---|
| 2,664,792 A | | 1/1954 | Cook | |
| 3,150,037 A | * | 9/1964 | Lee | 162/208 |
| 4,406,739 A | * | 9/1983 | Kankaanpaa | 162/203 |

FOREIGN PATENT DOCUMENTS

| | | | |
|---|---|---|---|
| DE | 28 08 939 A1 | | 9/1979 |
| FI | 106730 B | | 3/2001 |
| WO | WO 98/29600 A1 | | 7/1998 |
| WO | WO 01/31120 | * | 5/2001 |
| WO | WO 2004/020734 A1 | | 3/2004 |

OTHER PUBLICATIONS

International Preliminary Examination Report Issued in PCT/FI2003/000622, Oct. 28, 2004.
International Search Report Issued in PCT/FI03/00622, Oct. 28, 2003.

* cited by examiner

*Primary Examiner*—Eric Hug
(74) *Attorney, Agent, or Firm*—Stiennon & Stiennon

(57) ABSTRACT

A web is formed between two wire loops (13, 14), in a wire section of a paper or board machine, in connection with which dewatering elements (12, 17, 15, 28) are placed and in which water is drained from a stock suspension from between the two wires (13, 14). In the region of a twin-wire zone, a suction roll (15) is placed within one wire loop and a suction box (16) having a curved surface is situated in opposed relationship with the suction roll (15) on the wire loop. After the suction box (16), the web is guided, due to the effect of a vacuum of the suction roll (15), forwards on the surface of the wire loop of the suction roll (15).

10 Claims, 2 Drawing Sheets

ARRANGEMENT FOR A WIRE SECTION OF A PAPER OR BOARD MACHINE

CROSS REFERENCES TO RELATED APPLICATIONS

This application is a U.S. national stage application of International App. No. PCT/FI2003/000622, filed on Aug. 26, 2003, the disclosure of which is incorporated by reference herein, and claims priority on Finnish App. No. 20021534, filed Aug. 28, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for a wire section of a paper or board machine, in which a web is formed between two wire loops, in connection with which dewatering elements are placed and in which water is drained from a stock suspension from between said two wires.

In paper or board machines, stock is passed from a headbox to a forming section, i.e. a wire section, in which water is removed from the stock and a web is formed. In the forming section, or the wire section, different types of formers are used in which water is drained from the web usually between two wires.

As known in the prior art, in the manufacture of paper and board webs, a stock is thus prepared first for the headbox, and fibre material, fillers, and fines and additives are mixed with said stock. The stock system mixes the fibres and fillers as well as fines and additives, if any, to form a stock that is as homogeneous as possible in order to be fed to the headbox of a paper or board machine. The headbox spreads the stock suspension produced evenly to the forming section, i.e. the wire section, where dewatering and the couching of the web begin.

Several different types of wire sections, or formers, in themselves known to a person skilled in the art, are known in the prior art: fourdrinier formers, hybrid formers and gap formers. A board machine may comprise several wire units. In forming sections, water is removed by means of forming rolls, suction rolls and by means of blade shoes or the equivalent, which blade shoes typically have several vacuum chambers, so that the use of vacuum makes pressure pulses more effective. Loadable blades are generally placed on the opposite side of the web to assist dewatering by producing shear forces in the suspension within the web, which shear forces break up fibre flocs, thus improving the forming of the web. After that, the fibrous web in formers is generally passed onto a suction roll, which further removes water from the web, after which the web is generally passed to a press section. In connection with the suction roll, water guide plates or water collecting plates have generally been used for recovering the exiting water. This has led to asymmetric dewatering to some extent and it has not been possible to regulate the distribution of dewatering in this arrangement to improve asymmetry.

EP patent 912798 (corresponding FI patent application 965277) discloses a suction box in a paper machine and a method in a suction box of a paper machine. This document describes a suction box in which a vacuum chamber deck or a set of blades in an equivalent position forms a curved support surface for a wire at least in a running situation. In this kind of suction box, the friction between the wire and the blades or between the wire and the deck is very small. This document describes the use of a suction box placed on a wire run between two rolls, in which connection the suction box enables the run of the wire to be curved, and the use of the box at a wire guide roll, over which wire guide roll two wires are running, so that the run of the wire on the side of the box can be made curved by means of the suction box.

FI patent 106730 discloses an arrangement in the wet end of a paper machine for transferring a web from a forming section to a press section. The forming section comprises a twin-wire zone defined mutually by an upper wire loop and a lower wire loop, after which the web is arranged to follow the upper wire at the point at which the web is transferred from the underside of the upper wire onto the top side of a fabric situated in the press section. At the end of the twin-wire zone there is a suction box within the upper wire loop and, in opposed relationship with the suction box, an open roll within the lower wire loop, the suction box having a deck which is curved at least in a running situation such that the tension of the upper wire reduces the normal force caused by the vacuum of the suction box between the wire and the deck, and which suction box can be provided with a vacuum which keeps the web at the suction box mainly apart from the roll and from the lower wire while adhering to the underside of the upper wire and conforming to the curved shape of the deck of the suction box. Members are arranged in connection with the suction box and/or the roll for making the web follow the lower wire in a break situation to conduct it to the broke handling system. In the arrangement disclosed here, the web continues to travel on the surface of the wire on the side of the suction box.

SUMMARY OF THE INVENTION

An object of the invention is to eliminate or at least minimize the problems described above and encountered in the prior art applications.

An object of the invention is to provide a wire section of a paper or board machine which provides a more uniform distribution of dewatering than that of the prior-art wire sections.

One object of the invention is also to create a wire section by means of which a higher dry solids content is achieved before a press section, thus making it possible to shorten the wire section. Alternatively, the arrangement in accordance with the invention enables the running speed of the paper machine to be increased in wire section rebuilds.

The arrangement in accordance with the invention makes it possible to replace the traditionally used, large and expensive suction roll of the wire section with a smaller and less expensive suction roll because the force acting then on the suction roll is lower than in conventional arrangements.

In accordance with the invention, a suction box, in which the deck or blades of the suction box can be adjusted to be curved at least in a running situation or the wire run in the area of the suction box is curved, is placed in connection with a suction roll, which makes it possible to control the asymmetry of dewatering and, in addition, a higher dry solids content is imparted to the web before a press section, so that it is possible to shorten the wire section, when desired, because it is possible, for example, to omit one suction box situated on the run of the wire since the dewatering capacity increases when the arrangement in accordance with the invention is used.

The invention can be applied in connection with different types of formers, both with vertical and horizontal formers and, advantageously, with hybrid and gap formers.

The invention is applied in the twin-wire zone of the wire section, so that a suction box having, at least during running, a curved surface is placed within an upper wire loop at a suction roll situated within a lower wire loop. After that, in accordance with the invention, the web is caused to continue its travel on the surface of the lower wire. Advantageously, after the portion covered by the suction box, the roll has a suction zone in which the web is separated by means of vacuum such that the web starts to follow the lower wire. Alternatively, a suction box with a curved surface can be situated on the side of the lower wire loop and the roll can be situated on the side of the upper wire loop.

In an advantageous arrangement of the invention, a curved surface suction box is placed at a suction roll, which suction roll is provided with two suction zones, the first of which removes water and the second of which is arranged in the suction roll after the area covered by the suction box, the web being separated from the upper wire by means of a vacuum produced in the latter suction zone such that the web continues its travel on the surface of the lower wire loop and does not start to follow the upper wire.

The suction roll may also comprise only one suction zone, in which connection the suction zone is situated at least partly after the curved surface suction box in the running direction of the web. In that case, the web is separated from the upper wire by means of the vacuum of the suction zone of the suction roll such that the web continues its travel on the surface of the lower wire loop.

In the arrangement in accordance with the invention, a curved surface suction box is thus placed on the side of the upper wire loop, thereby achieving a better distribution of dewatering because in the prior art applications the distribution of dewatering of a web has generally been asymmetric, and the arrangement in accordance with the invention makes it possible to improve the distribution of dewatering because a curved surface suction box is placed on the opposite side of the web with respect to the suction roll, thereby allowing dewatering to be regulated in both directions. The arrangement in accordance with the invention thus provides a more uniform distribution of dewatering, so that the web is not formed in an asymmetric manner.

Further, by regulating the dewatering ratio between two curved surface suction boxes it is possible to fine tune the two-sidedness of the paper being formed (absorption properties, filler distribution).

In accordance with the invention according to an advantageous additional feature, a curved surface suction box is also placed in connection with a transfer suction roll which is situated at the end of a wire section and by which the web is transferred to a press section, so that by means of the curved surface suction box placed against the roll, rewetting of the web can be prevented and the dry solids content of the web is increased. By regulating the vacuum levels of both curved surface suction boxes it is possible to control the two-sidedness of paper.

In connection with the invention, a low vacuum can be used in the transfer suction roll and a large, massive suction roll having a high vacuum is not needed as the suction box assists in the transfer of the web.

In the following, the invention will be described in greater detail with reference to the figures in the appended drawing, but the invention is by no means meant to be narrowly limited to the details of the figures.

DESCRIPTION OF THE PREFERRED EMBODIMENTS

Figure 1:
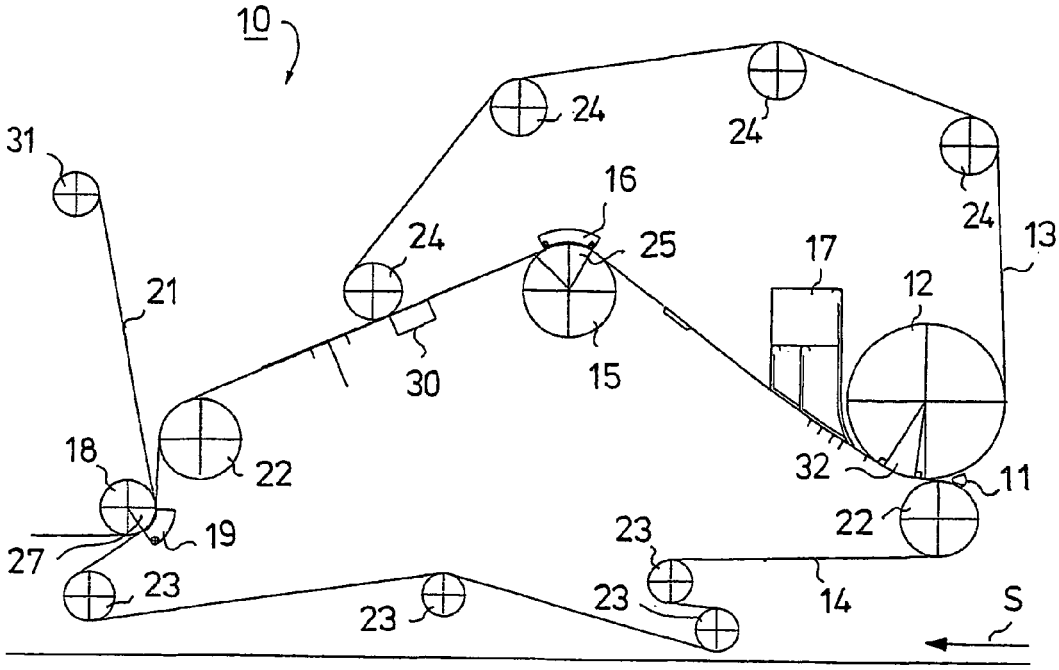
FIG. 1 is a schematic view of one application of the invention in a horizontal former.

In the following FIGS. 1-4, the same reference numerals are used of parts corresponding to one another. FIGS. 1-4 illustrate different applications for formers, a horizontal gap former in FIGS. 1 and 2, a vertical gap former in FIG. 3 and a horizontal hybrid former in FIG. 4. The principal running direction of the web is denoted with the reference arrow S. A stock suspension is supplied from a slice opening of a headbox 11 to a former 10, in which in the applications shown in FIGS. 1-3 it first meets a forming roll 12 which forms a gap with a guide roll 22. In the application shown in FIG. 4, the stock is supplied from the headbox 11 to a fourdrinier wire section 29 of the former 10 onto the surface of a lower wire loop 14.

Figure 2:
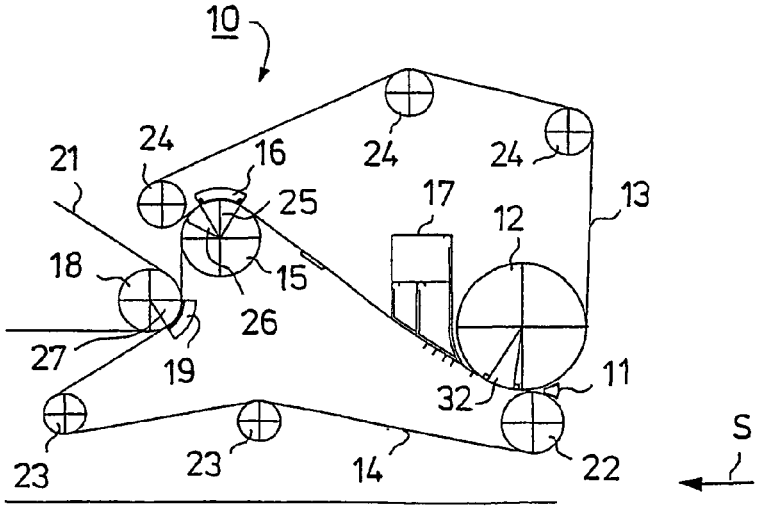
FIG. 2 is a schematic view of another application of the invention in a horizontal former.
Figure 3:
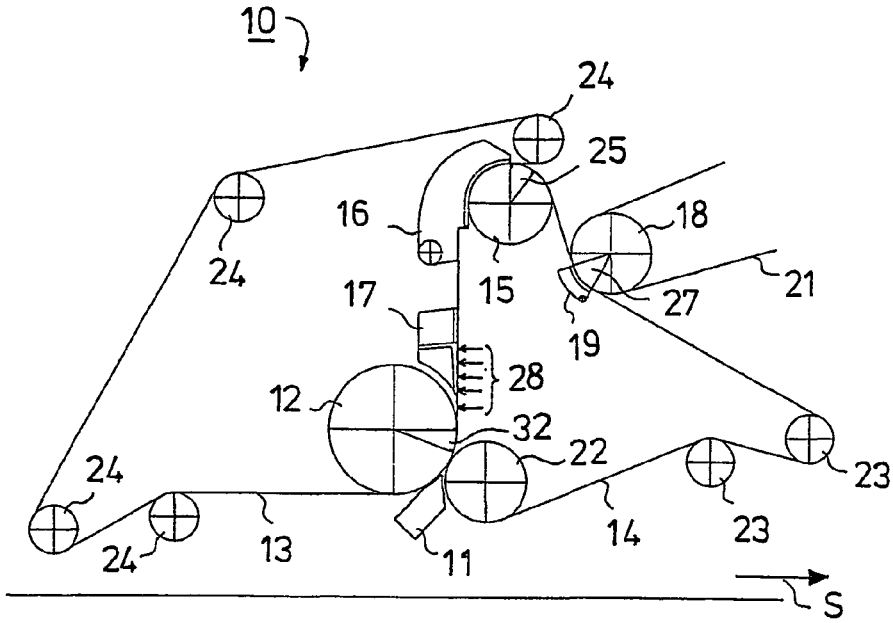
FIG. 3 is a schematic view of one application of the invention in a vertical design former.
Figure 4:
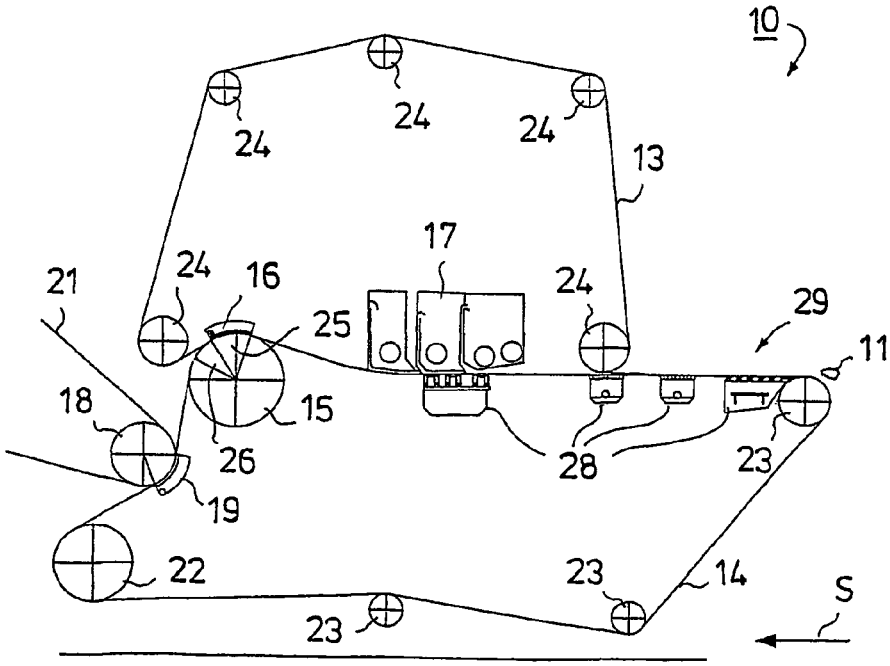
FIG. 4 is a schematic view of one application of the invention in a hybrid former.

In the applications shown in each of FIGS. 1-4, the former 10 comprises two wire loops 13, 14. The upper wire loop 13 runs while guided by alignment and guide rolls 24. The lower wire loop 14 runs while guided by alignment and guide rolls 22, 23. In the gap former applications shown in FIGS. 1-3, the forming roll 12 and blade dewatering members 17 comprising vacuum chambers for removal of water are placed within the upper wire loop. In FIGS. 3 and 4, blade dewatering members 17 comprising vacuum chambers are placed within the upper wire loop 13 and loading blades 28 are placed within the lower wire loop 14 for loading the blade in order to produce transverse shear forces and to remove water from the stock suspension.

In FIGS. 1-4, a suction roll 15 is placed within the lower wire loop 14 for removing water from the web. A curved surface vacuum box 16 is placed within the upper wire loop 13 at the suction roll 15, thereby allowing the two-sidedness of the web to be improved because the vacuum box 16 is placed on the side of the upper wire loop. In the applications shown in FIGS. 1-4, the suction roll 15 is provided with a transfer suction zone 26, which assures that the web remains on the surface of the lower wire loop when the upper wire is separated from the surface of the web. In the application shown in FIG. 1, after the suction roll 15 the web is passed on the surface of the lower wire loop towards a press section. The web is transferred from the former 10 to the press section by means of a transfer suction roll 18, which is provided with a suction zone 27 to separate the web on the surface of the lower wire 14. In the applications shown in FIGS. 1, 2 and 4, the suction roll 15 is provided with a suction zone 25 for sucking water from the web. In FIGS. 1-4, a press felt or equivalent of the press section is denoted with the reference numeral 21 and its run is guided by alignment and guide rolls 31 (FIG. 1).

In the application shown in FIG. 1, a stock suspension is fed from a headbox 11 to a gap former 10, in which it first meets a forming roll 12 having a dewatering zone 32 in which water is removed from the stock suspension. After that there are blade dewatering members 17, by means of which water is removed further from the upper surface of the web. After that, the web is passed over a suction roll 15, a curved surface suction box 16 being placed at the suction roll 15 on the other side of wires 13, 14 within the upper wire loop 13, so that water is removed from the web both by means of the suction roll 15 and by means of the suction box 16. The suction zone 25 of the suction roll 15 extends in the running direction of the web beyond the area of action of the suction box 16, whereby it is assured that the web adheres to the surface of the lower wire 14. The run of the web on the surface of the lower wire loop 14 is ensured by means of a suction box 30. The web is passed on the surface of the lower wire loop 14 further towards a press section and to further processing from between a suction roll 18 placed within the following belt, felt or wire loop 21 and a curved surface suction box 19 placed on the opposite side of the suction roll 18.

In the application shown in FIG. 2, the upper wire loop 13 starts to turn upwards immediately after a suction roll 15, in which connection the web is prevented from starting to follow the upper wire 13 by means of a suction zone 26 of the suction roll 15 and the web is kept on the side of the lower wire loop 14. From here the web is passed downwards on the surface of the lower wire loop 14 towards a transfer onto the following press felt or equivalent 21, which transfer is accomplished by means of a transfer suction roll 18 and a curved surface suction box 19, by which suction box 19 the dry solids of the web is increased and, at the same time, rewetting of the web is prevented.

FIG.3 shows a vertical former 10 with a forming section placed vertically, and in this application a stock suspension is fed from a headbox 11 between wire loops 13, 14, and water is removed on a forming roll 12 in a dewatering zone 32, after which there are dewatering elements 17, 28, in which water is removed into vacuum boxes as blade dewatering. After that, the web is passed to a curved surface suction box 16 placed at a suction roll 15 between the wire loops 13, 14, where water is removed from the web by means of the suction box 16, after which the web is passed on the surface of the lower wire 14 forwards and the web is separated from the upper wire in a transfer suction zone 26 of the suction roll 15. After that there is, in a corresponding manner, a suction roll 18, a curved surface suction box 19 being placed opposite the suction roll 18 for increasing the dry solids of the web and for preventing rewetting, and the web is passed to the following processing step.

FIG. 4 shows a former in which there is first a fourdrinier section 29 in which water is removed as blade dewatering 17 and, after the blade dewatering portion where the web runs on the substantially horizontal surface of the lower wire loop 14, the web is passed to a suction roll 15 opposed by a curved surface suction box 16, by means of which, together with the suction roll 15, the asymmetry of dewatering is controlled, and the web is passed on the surface of the lower wire loop. The transfer of the web forwards on the surface of the lower wire loop is assured by means of a transfer suction zone 26 of the suction roll 15, which transfer suction zone is situated after the curved surface suction box 16. The web is transferred to further processing by means of a suction roll 18 and a curved surface suction box 19, which suction box 19 serves to prevent rewetting of the wire at the same time.

Above, the invention has been described with reference to some of its advantageous exemplifying embodiments only, but the invention is by no means intended to be narrowly limited to the details of said embodiments.

The invention claimed is:

1. A forming section of a paper or board machine, comprising:

a first forming wire forming a first wire loop and mounted to travel in a defined running direction, the first wire loop having a web receiving surface;

a second forming wire forming a second wire loop which forms a twin-wire zone with the first forming wire, and which is mounted to travel in the defined running direction;

a suction roll positioned within the first wire loop, the suction roll having a cylindrical suction surface engaged with the first forming wire, and having a suction zone;

a suction box having a curved surface positioned within the second wire loop and positioned with the curved surface in opposed relationship with the suction roll;

wherein the suction zone of the suction roll has a portion which extends in the running direction beyond the suction box so that a web passing between the suction roll and the suction box is guided, due to the effect of the suction zone of the suction roll, forwards on the web receiving surface of the first wire loop; and wherein the suction roll suction zone is divided into a first suction zone opposite the suction box, and a second suction zone which forms the portion which extends in the running direction beyond the suction box so that a web passing between the suction roll and the suction box is guided, due to the effect of the second suction zone of the suction roll, forward on the web receiving surface of the first wire loop.

2. The forming section of claim 1, wherein the second wire loop is separated from the first forming wire while opposite the suction roll.

3. The forming section of claim 1, wherein the first forming wire is positioned beneath the second forming wire in the twin-wire zone.

4. A forming section of a paper or board machine, comprising:

a first forming wire forming a first wire loop and mounted to travel in a defined running direction, the first wire loop having a web receiving surface;

a second forming wire forming a second wire loop which forms a twin-wire zone with the first forming wire, and which is mounted to travel in the defined running direction;

a suction roll positioned within the first wire loop, the suction roll having a cylindrical suction surface engaged with the first forming wire, and having a suction zone;

a suction box having a curved surface positioned within the second wire loop and positioned with the curved surface in opposed relationship with the suction roll;

wherein the suction zone of the suction roll has a portion which extends in the running direction beyond the suction box so that a web passing between the suction roll and the suction box is guided, due to the effect of the suction zone of the suction roll, forwards on the web receiving surface of the first wire loop;

a third wire or felt, forming a third loop;

a second suction roll within the third wire or felt;

a second suction box having a curved surface positioned within the first wire loop and positioned with the curved surface in opposed relationship with the second suction roll; and wherein the second suction roll is arranged to pass a web from the web receiving surface of the first wire loop to the third wire or felt.

5. The forming section of claim 4, wherein the second suction box is arranged to prevent rewetting of a web as the web passes from the first wire to the third wire or felt.

6. A method for forming a paper web in a forming section of a paper or board machine, comprising the steps of:

supplying a stock suspension from a headbox to a twin wire former having a first forming wire forming a first wire loop and traveling in a running direction, the first wire loop having a web receiving surface, and the twin wire former having a second forming wire forming a second wire loop which forms a twin-wire zone with the first forming wire and travels in the running direction:

removing water from a web formed from the stock suspension through a first side with a suction roll positioned within the first wire loop, the suction roll having a suction zone engaged with the first forming wire, the water being removed by suction of the suction roll through the web receiving surface:

removing water from the web through a second side opposite the suction roll with a suction box which conforms to a sector of the suction roll and forms a curved surface positioned within the second wire loop, the suction box positioned with the curved surface in opposed relationship with the suction roll;

guiding the web after the suction box by a portion of the suction zone which extends in the running direction beyond the suction box so that the web passes between the suction roll and the suction box and is guided, due to the effect of the suction zone of the suction roll, forwards on the web receiving surface of the first wire loop; and regulating a dewatering ratio between the suction roll and the suction box to control the two-sidedness of the paper web.

7. A method for forming a paper web in a forming section of a paper or board machine, comprising the steps of:

supplying a stock suspension from a headbox to a twin wire former having a first forming wire forming a first wire loop and traveling in a running direction, the first wire loop having a web receiving surface, and the twin wire former having a second forming wire forming a second wire loop which forms a twin-wire zone with the first forming wire and travels in the running direction:

removing water from a web formed from the stock suspension through a first side with a suction roll positioned within the first wire loop, the suction roll having a suction zone engaged with the first forming wire, the water being removed by suction of the suction roll through the web receiving surface:

removing water from the web through a second side opposite the suction roll with a suction box which conforms to a sector of the suction roll and forms a curved surface positioned within the second wire loop, the suction box positioned with the curved surface in opposed relationship with the suction roll:

guiding the web after the suction box by a portion of the suction zone which extends in the running direction beyond the suction box so that the web passes between the suction roll and the suction box and is guided. due to the effect of the suction zone of the suction roll, forwards on the web receiving surface of the first wire loop; and wherein the suction roll suction zone is divided into a first suction zone opposite the suction box, and a second suction zone which forms the portion which extends in the running direction beyond the suction box, and wherein the step of guiding the web is performed with the second suction zone of the suction roll.

8. The method of claim 7 further comprising the step of separating the second wire from the first forming wire while the second wire is opposite the suction roll.

9. The method of claim 7, further comprising the step of forming the twin-wire zone with the first forming wire positioned beneath the second forming wire.

10. A method for forming a paper web in a forming section of a paper or board machine, comprising the steps of:

supplying a stock suspension from a headbox to a twin wire former having a first forming wire forming a first wire loop and traveling in a running direction, the first wire loop having a web receiving surface, and the twin wire former having a second forming wire forming a second wire loop which forms a twin-wire zone with the first forming wire and travels in the running direction;

removing water from a web formed from the stock suspension through a first side with a suction roll positioned within the first wire loop, the suction roll having a suction zone engaged with the first forming wire, the water being removed by suction of the suction roll through the web receiving surface;

removing water from the web through a second side opposite the suction roll with a suction box which conforms to a sector of the suction roll and forms a curved surface positioned within the second wire loop, the suction box positioned with the curved surface in opposed relationship with the suction roll;

guiding the web after the suction box by a portion of the suction zone which extends in the running direction beyond the suction box so that the web passes between the suction roll and the suction box and is guided. due to the effect of the suction zone of the suction roll, forwards on the web receiving surface of the first wire loop;

passing the web on to a third wire or felt forming a third loop with a second suction roll positioned within the third loop; and preventing rewetting of the web as the web passes from the first wire to the third wire or felt with a second suction box having a curved surface positioned within the first wire loop and positioned with the curved surface in opposed relationship with the second suction roll.

* * * * *